US011702865B2

(12) United States Patent
Howlett et al.

(10) Patent No.: US 11,702,865 B2
(45) Date of Patent: Jul. 18, 2023

(54) SECURITY GATE

(71) Applicant: Companion Systems, North Salt Lake, UT (US)

(72) Inventors: James Howlett, Kaysville, UT (US); Aaron Bagwell, Layton, UT (US)

(73) Assignee: COMPANION SYSTEMS, North Salt Lake, UT (US)

( * ) Notice: Subject to any disclaimer, the term of this patent is extended or adjusted under 35 U.S.C. 154(b) by 0 days.

(21) Appl. No.: 17/814,422

(22) Filed: Jul. 22, 2022

(65) Prior Publication Data

US 2023/0021691 A1 Jan. 26, 2023

Related U.S. Application Data

(60) Provisional application No. 63/224,734, filed on Jul. 22, 2021.

(51) Int. Cl.

| | |
|---|---|
| ***E05B 65/00*** | (2006.01) |
| ***G07F 19/00*** | (2006.01) |
| *G08B 21/18* | (2006.01) |

(52) U.S. Cl.

CPC ..... *E05B 65/0075* (2013.01); *G07F 19/205* (2013.01); *G08B 21/182* (2013.01)

(58) Field of Classification Search

CPC .... E05B 65/0075; E05B 65/00; G07F 19/205; G07F 19/201; G08B 21/182; Y10T 70/5155; Y10T 70/5031; Y10T 70/5097; Y10T 70/5168; Y10T 70/554; Y10T 70/5544; Y10T 70/5549; Y10T 70/5553; Y10T 70/5558

USPC ..... 70/63, 78, 94, 159–162, 91

See application file for complete search history.

(56) References Cited

U.S. PATENT DOCUMENTS

| | | | | |
|---|---|---|---|---|
| 2,117,102 A | | 5/1938 | Pittler | |
| 3,665,736 A | | 5/1972 | Wilson | |
| 4,054,184 A | | 10/1977 | Marcinko | |
| 4,099,598 A | | 7/1978 | Clinard | |
| 4,418,551 A | * | 12/1983 | Kochackis | G07F 9/10 70/164 |
| 4,524,866 A | | 6/1985 | Pollacco | |

(Continued)

FOREIGN PATENT DOCUMENTS

| | | | | |
|---|---|---|---|---|
| GB | 2440027 A | | 1/2008 | |
| GB | 2458347 A | | 9/2009 | |
| WO | WO-2019224669 A1 | * | 11/2019 | E05G 1/024 |

*Primary Examiner* — Suzanne L Barrett

(74) *Attorney, Agent, or Firm* — Kunzler Bean & Adamson

(57) ABSTRACT

Apparatus to secure an Automated Teller Machine (ATM) or other structure are disclosed herein. One apparatus includes an arm including an attachment and a lockpin that engages the attachment in an engaged position. The lockpin is configured to prevent the arm from disengaging from the engaged position when a force is applied to the arm. Another apparatus includes an arm including an attachment that prevents rotation of the arm, a lockpin that engages the attachment in an engaged position, and a lock connected to the lockpin to prevent releasing the lockpin from the engaged position. An ATM includes a frame, a gate, and an abutment. The gate includes an arm including an attachment that locks the arm. The abutment includes a lockpin that engages the attachment in an engaged position to prevent the arm from unlocking and a lock connected to the abutment to prevent access to the lockpin.

20 Claims, 18 Drawing Sheets

(56) References Cited

U.S. PATENT DOCUMENTS 4,802,599 A 2/1989 Hill
4,880,156 A 11/1989 Wallet
4,930,602 A 6/1990 Gust
5,067,530 A 11/1991 Short, III
5,108,166 A * 4/1992 Klix ..... G07F 19/205 312/329
5,257,581 A * 11/1993 Welling ..... E05C 19/003 292/259 R
D383,271 S 9/1997 Eshelman
5,813,643 A 9/1998 Zybert
5,915,802 A * 6/1999 Siler ..... E05B 65/467 109/47
5,952,921 A 9/1999 Donnelly
6,085,806 A 7/2000 Davis et al.
6,118,376 A 9/2000 Regester
6,407,667 B1 6/2002 Jackson et al.
6,696,950 B2 2/2004 Adolphson
6,698,569 B2 3/2004 Kaehler
6,868,702 B1 3/2005 Alkire
6,925,843 B1 * 8/2005 Pols Sandhu ..... G06F 1/183 70/160
6,971,322 B2 12/2005 DuBois et al.
7,207,902 B1 4/2007 Hamlin
7,476,804 B2 * 1/2009 Adducci ..... H02B 1/202 312/265.2
7,503,481 B2 * 3/2009 Ramachandran ..... G07F 19/20 902/8
7,726,621 B1 6/2010 Dellinger
8,094,011 B2 1/2012 Faris et al.
9,184,573 B1 11/2015 Jonas et al.
9,683,401 B2 * 6/2017 Smith ..... E05B 65/0075
9,926,726 B1 3/2018 Santosa
10,689,885 B2 * 6/2020 Loudenslager ..... E05C 21/00
11,189,138 B2 11/2021 Anderson
2003/0221596 A1 * 12/2003 Guinan ..... E05B 63/14 109/24.1
2004/0177794 A1 * 9/2004 DuBois ..... G07F 9/10 109/24.1
2006/0255918 A1 11/2006 Bernstein et al.
2007/0191126 A1 8/2007 Mandracken
2008/0078223 A1 * 4/2008 Amir ..... A45C 11/32 70/456 R
2008/0136642 A1 6/2008 Wise
2008/0214111 A1 9/2008 Moshir et al.
2009/0233735 A1 9/2009 Savarese et al.
2015/0191950 A1 7/2015 Bartley
2020/0051403 A1 * 2/2020 Neufeld ..... E05G 1/024
2020/0118396 A1 * 4/2020 Neufeld ..... G07F 19/205

* cited by examiner

SECTION C-C

SECURITY GATE

REFERENCE TO RELATED APPLICATION

This application claims priority to and the benefit of U.S. Provisional Patent Application No. 63/224,734, filed on Jul. 22, 2021, the contents of which are incorporated herein by reference in their entirety.

FIELD

This disclosure generally relates to securing outdoor vending machines. In particular, the disclosure relates to protecting money cassettes within an automated teller machine (ATM).

BACKGROUND

Automated Teller Machines (ATMs) provide an automated user experience to withdraw funds from a user's bank account. Customers have come to appreciate the accessibility and availability of the ATM. For example, ATMs can provide customers access to money within a checking account after-hours, late at night when the bank is closed. The accessibility to the customer's checking account has automated several aspects of the banking relationship and provides customers with an alternative means to access funds after hours or without transacting with a human banker.

However, this ease of access comes at a price. Organized criminals and N others have begun stealing ATMs and/or breaking into ATMs to expose money cassettes housed therein. A structural method of securing the ATM is needed that prevents criminal activity without impinging on the accessibility of legitimate banking customers.

SUMMARY

The subject matter of the present application has been developed in response to the present state of the art, particularly in response to the shortcomings of securing outdoor Automated Teller Machines (ATMs) that currently available techniques have not fully solved. Accordingly, the subject matter of the present application has been developed to provide a gate and/or frame to lock the ATM and overcome at least some of the above-discussed shortcomings of prior art techniques.

The following is a non-exhaustive list of examples, which may or may not be claimed, of the subject matter, disclosed herein.

In one embodiment, an apparatus comprising an arm, a lockpin, and a lock is described. The arm includes an attachment. The lockpin engages the attachment in an engaged position and the lock locks an abutment that provides access to release the lockpin from the engaged position. In response to applying a force to rotate the arm in the engaged position, the lockpin restrains the arm, and the force is not distributed to the lock. The preceding subject matter of this paragraph characterizes example 1 of the present disclosure.

The arm may include a rotatable rod that extends axially through the arm. The rotatable rod may be free to rotate within the arm and/or housed within the arm. The preceding subject matter of this paragraph characterizes example 2 of the present disclosure, wherein example 2 also includes the subject matter according to example 1 above.

The arm may include a reinforced steel wall that is at least 0.5 inches thick. The preceding subject matter of this paragraph characterizes example 3 of the present disclosure, wherein example 3 also includes the subject matter according to example 1 above.

In various embodiments, a heat sensor, a vibration sensor, and/or a contact switch may send an alarm signal to activate/trigger an alarm when heated, jarred, or when the arm and the abutment are not in contact. In one embodiment, the contact switch determines a pressure between the attachment of the arm and the receiver of the abutment and sends the alarm signal to activate/trigger an alarm when the lock has not received a key and the pressure is below a threshold. The preceding subject matter of this paragraph characterizes examples 4-7 of the present disclosure, wherein examples 4-7 also includes the subject matter according to example 1 above.

In various embodiments, the lockpin includes multiple points of contact with the attachment. For example, the lockpin may bear against the attachment in double shear. The preceding subject matter of this paragraph characterizes examples 8-9 of the present disclosure, wherein examples 8-9 also includes the subject matter according to example 1 above.

In another embodiment, an apparatus includes an arm, a lockpin, and a lock. The arm includes an attachment configured to lock the arm to prevent rotation of the arm. The lockpin engages the attachment of the arm in an engaged position and the lock couples to the lockpin to prevent releasing the lockpin from the engaged position. In response to a force to rotate the arm in the engaged position, the lock is not engaged. The preceding subject matter of this paragraph characterizes example 10 of the present disclosure.

The lockpin may include a double-shear lockpin. The preceding subject matter of this paragraph characterizes example 11 of the present disclosure, wherein example 11 also includes the subject matter according to example 10 above.

The the lockpin may include a tongue. The tongue extends from the lockpin and the lock engages the tongue in a locked position to prevent removal of the lockpin. When the lockpin is in the engaged position, the force to rotate the arm bears on the lockpin and fails to bear against the lock. The preceding subject matter of this paragraph characterizes example 12 of the present disclosure, wherein example 12 also includes the subject matter according to example 10 above.

In various embodiments, the apparatus includes a frame. The frame may include a first stile at a first front end, a second stile at a second front end opposite the first front end, and a rail extending between the first stile and the second stile. A cover may extend between the first stile and the second stile and at least partially surround the arm and the attachment when coupled to the abutment. The preceding subject matter of this paragraph characterizes example 13 of the present disclosure, wherein example 13 also includes the subject matter according to example 10 above.

In some embodiments the frame includes a base plate, a third stile, a fourth stile, and a rear rail. The third stile is located at a third rear end and coupled to a rear of the base plate at the third rear end opposite the first stile at the first end. The fourth stile is located at a fourth rear end and coupled to the rear of the base plate at the fourth end opposite the second stile at the second end. The rear rail extends between the third stile and the fourth stile opposite the rail extending between the first stile and the second stile, such that the frame surrounds a structure. The preceding subject matter of this paragraph characterizes example 14 of the present disclosure, wherein example 14 also includes the subject matter according to example 13 above.

The frame may include a left panel coupled to and extending between the first stile and the third stile, a right panel coupled to and extending between the second stile and the fourth stile, and a back panel coupled to and extending between the third stile and the fourth stile. A cap may be coupled to the rail and the rear rail and extend between the cover, the back panel, the left panel, and the right panel. The first stile, the second stile, the third stile, and the fourth stile may be coupled to the base plate. The rail may be coupled to the first stile and the second stile and the rear rail may be coupled to the rear third stile and the rear fourth stile. The preceding subject matter of this paragraph characterizes example 15 of the present disclosure, wherein example 15 also includes the subject matter according to example 14 above.

In some embodiments, the first stile, the second stile, the third stile, and the fourth stile may be fabricated from and/or comprise reinforced steel and the frame may be disposed around the structure with a predetermined clearance between the frame and the structure. The preceding subject matter of this paragraph characterizes example 16 of the present disclosure, wherein example 16 also includes the subject matter according to example 14 above.

In another embodiment, an Automated Teller Machine (ATM) is described including a frame, a gate, and a cover. The frame includes a base plate, a first stile coupled to the base plate at a first end, a second stile coupled to the base plate at a second end, and a rail extending over the base plate between the first stile and the second stile. The gate includes an arm with a pivot and an attachment. The attachment is configured to lock the arm to prevent rotation of the arm. The gate includes an abutment with a lockpin and a lock. The lockpin is configured to engage the attachment of the arm in an engaged position to prevent the arm from pivoting. The lock is couple to the abutment to prevent access to the lockpin in the abutment. In response to an applied force to rotate the arm when the lockpin is in the engaged position, the lock is not engaged. The preceding subject matter of this paragraph characterizes example 17 of the present disclosure.

The cover may completely enclose the abutment and the attachment of the arm. The preceding subject matter of this paragraph characterizes example 18 of the present disclosure, wherein example 18 also includes the subject matter according to example 17 above.

The base plate, the first stile, the second stile, and the rail may include reinforced steel. The first stile and the second stile may be coupled to the base plate, and the lock rail may be coupled to and/or extend between the first stile and the second stile. The preceding subject matter of this paragraph characterizes example 19 of the present disclosure, wherein example 19 also includes the subject matter according to example 17 above.

The frame may be located within a predetermined distance of the ATM. The frame may prevent wrapping a chain around the ATM without also encircling the frame. The preceding subject matter of this paragraph characterizes example 20 of the present disclosure, wherein example 20 also includes the subject matter according to example 17 above.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not, therefore, to be considered to be limiting of its scope, the subject matter will be described and explained with additional specificity and detail through the use of the drawings, in which.

DETAILED DESCRIPTION

Banks and their customers have adopted Automated Teller Machines (ATMs) for their accessibility, availability, and ease of use. However, crooks and thieves have noticed that ATMs are often left vulnerable and attack ATMs to break into the money cassettes included in each ATM. In general, a gate can be used in front of the ATM to make it more difficult for a would-be thief to break open the ATM. The gate secures the money cassettes within the ATM from being removed (e.g., by removing a front panel of the ATM). In addition, frames can be added to the gate to surround the ATM and prevent the removal of the ATM. For example, the frame prevents wrapping a chain around an unsecured ATM and is known as, a "chain attack."

The gate and/or frame is/are capable of being designed to withstand increased forces than a stand-alone ATM. The gate and/frame approach described herein permits banks and others to customize the security of the ATM. For example, an ATM housed partially within a brick building may use components of the gate and/or the front parts of a frame but may not need the rear frame. Similarly, a wholly exposed ATM may include a gate and front and rear portions of the frame to surround and secure the ATM completely. The gate and frame can be constructed to obscure the would-be criminal the locking mechanisms and may further be designed with fail-safes that make an attack fail by designing fail locations other than those the thief is most likely to attack. For example, in various embodiments disclosed herein, the lock protects a lockpin that needs to be removed to gain access to the interior of the ATM. However, the lock may not be subject to any force(s) (e.g., bending, bearing, and/or shear) when the ATM is attacked. The embodiments disclosed herein provide configurations that enable and/or allow a more robust and secure design of the frame and/or gate protecting an ATM.

Figure 1:
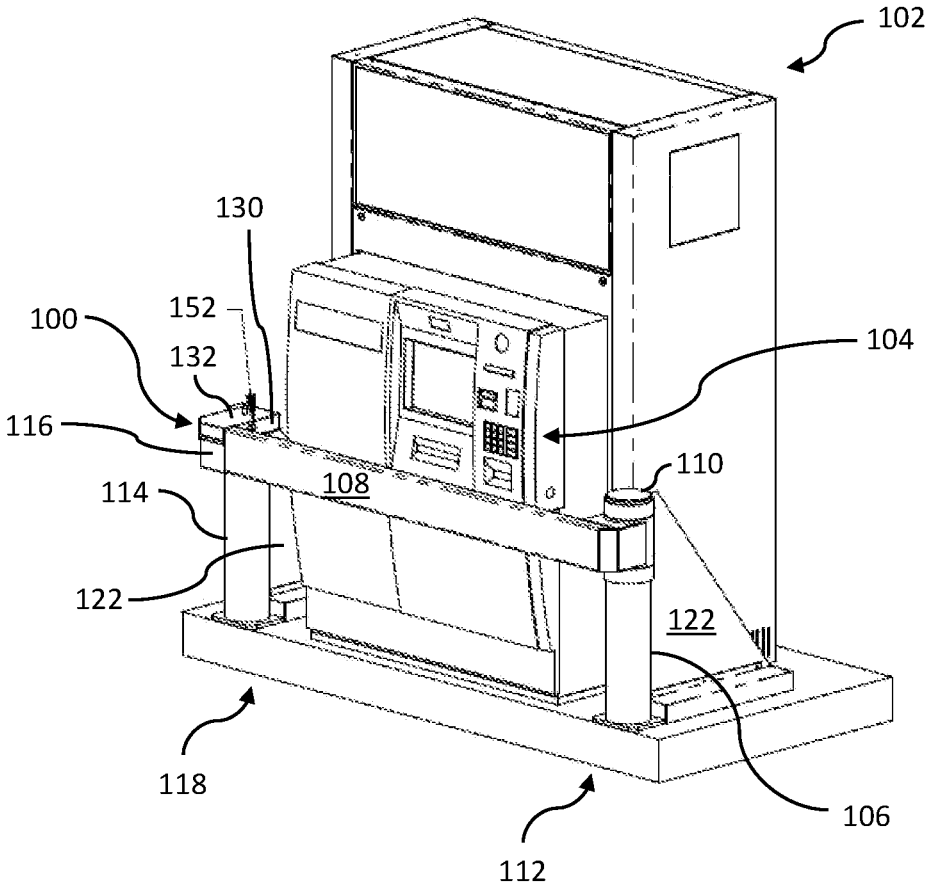
FIG. 1 shows a gate adjacent to an Automated Teller Machine (ATM), according to one or more examples of the present disclosure.

FIG. 1 shows a gate 100 adjacent to an ATM 102. The ATM 102 includes a computer with a front interface 104 that a user can access to deposit or withdraw money (e.g., from an affiliated bank account). A hinge column 106 secures and supports an arm 108 with a pivot 110 at a first end 112. A support post 114 couples to an attachment 116 of the arm 108 at a second end 118. In various embodiments, the hinge column 106 and support post 114 can include fasteners 120 that secure them to the ground or other support structures (e.g., encased in concrete).

The arm 108 pivots or rotates about the pivot 110 that secures the arm 108 on the first end 112 and locks at an abutment 122 at the second end 118 of the gate 100. The attachment 116 couples to form the abutment 122 on the post 114. The abutment 122 includes a lockpin 124 that engages the attachment 116 in an engaged position 126 to prevent the arm 108 from pivoting. The lockpin 124 engages the lock tabs 154 of the attachment 116 of the arm 108 in an engaged position 126 (see, FIG. 5) and prevents the arm 108 from rotating or pivoting at the pivot 110. A lock 128 locks the abutment 122 that provides a legitimate user (e.g., a user with a key) access to release or disengage the lockpin 124 from the engaged position 126.

The abutment 122 can include the lockpin 124 to lock the arm 108 relative to the post 114 and/or a puck lock (e.g., lock 128) secured to a secondary structure 130 of the abutment 122. The secondary structure 130 includes a structure that couples directly to the lock to prevent access to the lockpin 124. The secondary structure 130 of the abutment 122 can be a separate box-cover 132, as shown in FIG. 2, or any structure of the abutment 122 that does not take incidental loads (e.g., when an attempt to forcibly rotate the arm 108 in the locked and engaged position 126).

In other words, the lock 128 inhibits and/or prevents access to the lockpin 124 without a key 134. The lock 128 secures and locks the secondary structure 130 of the abutment 122 that provides user access to the lockpin 124. The lock 128 is coupled to the secondary structure 130 to inhibit the release of the lockpin 124 from the engaged position 126. The lockpin 124 secures the pin plate(s) 156 of the abutment 122 to the lock tabs 154 of the attachment 116 of the arm 108 to lock the gate 100 and prevent rotation at the pivot 110. For example, the lockpin 124 may experience a shear or bearing load between the attachment 116 and the arm 108 to lock the gate 100.

In response to an applied rotational force that attempts to rotate the arm 108 when the lockpin 124 is in the engaged position 126, the lockpin 124 restrains the arm 108 and distributes the force from the arm 108 to the hinge column 106 and/or the support post 114. In some embodiments, the lockpin 124 may include multiple points of contact (e.g., contact surface 136) with the attachment 116. For example, the lockpin 124 may bear against the arm 108 in double shear, as shown in FIG. 1, but the force is not distributed on the lock 128 or the secondary structure 130 of the abutment 122.

Figure 2:
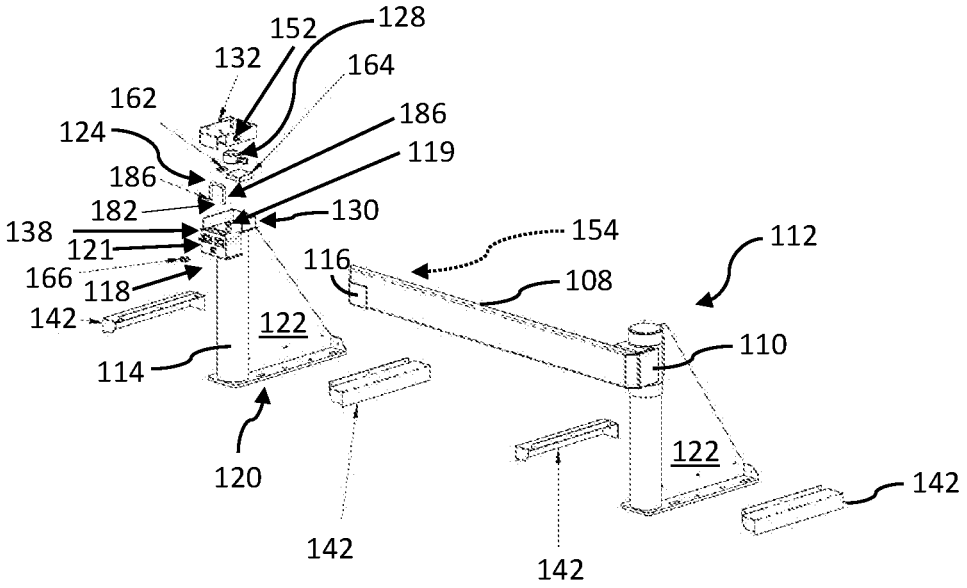
FIG. 2 is an exploded view of the gate in FIG. 1, according to one or more examples of the present disclosure.

FIG. 2 is an exploded view of the gate 100 and shows the abutment 122 with the lockpin 124 secured in capable of securing the lock tabs 154 of the attachment 116 of the arm 108 and the pin plate(s) 156 of the abutment 122. At least in the illustrated embodiment, the lock tabs 154 are inserted in a gap 121 between a pair of pin plates 156 of the abutment 122. The abutment 122 includes the box-cover 132 that couples to the post 114 at a support 138 (e.g., jamb). The lockpin 124 inserts into the lock tabs 154 of the attachment 116 of the arm 108 and the pin plate(s) 156 of the abutment 122 to secure the arm 108 relative to the post 114 at the second end 118. Stated differently, the lockpin 124 locks the pivot 110 of the arm 108 at the first end 112 and secures the lock tabs 154 of the attachment 116 of the arm 108 to the pin plate(s) 156 of the abutment 122 at the second end 118. The box-cover 132 can be secured with the lock 128 to create a boxlike structure that inhibits and/or prevents unauthorized access to the lockpin 124.

When the lockpin 124 is in the engaged position 126 it secures the lock tabs 154 of the attachment 116 of the arm 108 and the pin plate(s) 156 of the abutment 122 to the support 138 of the post 114. In the engaged position 126 the arm 108 is locked relative to the hinge column 106 and support post 114. The pivot 110 at the first end 112 is not free to rotate since the lockpin 124 is securing the attachment 116 and the arm 108 at the second end 118. Similarly, the lockpin 124 prevents rotation of the arm 108 at the second end 118 by securing and/or fastening the arm 108 to the support 138 of the post 114. The lock 128 functions to secure the box-cover 132 to the support 138 and inhibit or prevent unauthorized access to the lockpin 124 (e.g., without unlocking the lock 128). In other words, when the lockpin 124 is in the engaged position 126, a rotational force on the arm 108 (e.g., to open the gate 100) applies a reaction force (e.g., shear, bending, and/or bearing) on the lockpin 124 but does not force or bear on the lock 128. The lockpin 124 is in the load path but the lock 128 is not.

The lockpin 124 enhances the structural force that can secure the arm 108 relative to the hinge column 106 and/or support post 114. The locking mechanism of the lockpin 124 can provide a more robust design, materials, and/or contact area/surface 136 for the bearing area of the joint. For example, the lockpin 124 may include an increased number of contact surfaces 136 and/or increase the bearing area from the single shear joint of the lock 128 configuration to the double shear joint configuration shown in FIGS. 1 and 2. Additional contact surfaces 136 (e.g., 3, 4, 5, 6, etc.) similarly reduce the shear and/or bearing loads. For example, a lockpin 124 with four contact surfaces 136 reduces the shear load at each contact surface 136 that would otherwise be distributed on the lock 128 by a factor of four.

The lock 128 in FIG. 2 may also include a lock cover 140. The hidden nature of the lock 128 in this embodiment may obscure the structural design of the gate 100. For example, it may be more difficult to assess how the lock 128 is coupled and/or secures the arm 108. Secondary structure 130 may obstruct the structural design of the lockpin 124 and/or the lock 128. In other words, hiding the lock 128 and other components of the gate 100 can prevent an attack by occluding the structural design from a would-be attacker. For example, the box-cover 132 is secured to the lock 128 and obstructs the structural configuration, material, and/or orientation of the engaged position 126. The additional secondary structures 130 may also slow down an attack by increasing the time to disassemble an increased number of parts and/or inducing the attack on non-structural elements of the gate 100.

Bolt covers 142 may also capture and at least partially surround any bolts or fasteners 120 that secure the hinge column 106 and support post 114 to the ground. The post 114 may include multiple connections points to the ground. For example, the post 114 may be embedded in concrete and fastened to the ground with bolts and/or fasteners 120. The bolt cover 142 may hide or disguise how the hinge column 106 and support post 114 is grounded, and the attacker may not be able to inspect how the posts are secured. The bolt covers 142 and/or abutment 122 (e.g., the lockpin 124, secondary structures 130, etc.) may either prevent the attack, prolong the attack, and/or cause the attack to focus on the wrong structure, such as a non-structural secondary structure 130.

Figure 3:
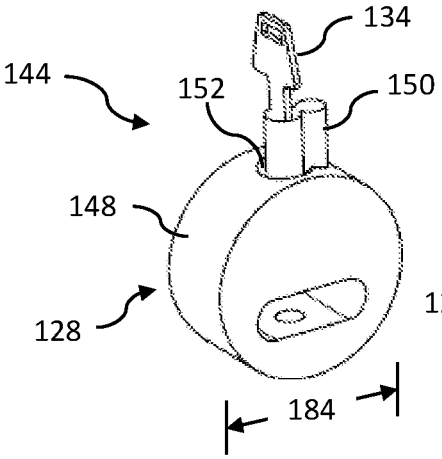
FIG. 3 shows a puck lock in an unlocked configuration, according to one or more examples of the present disclosure.
Figure 4:
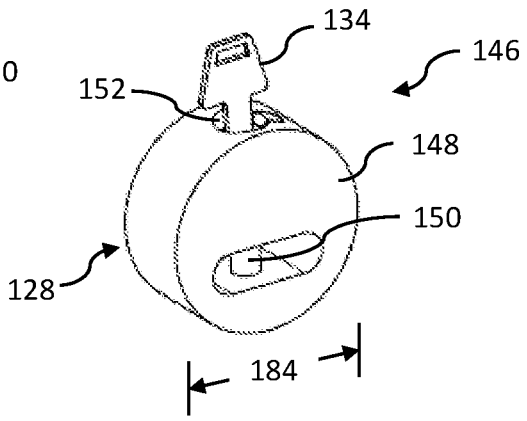
FIG. 4 shows a puck lock in a locked configuration, according to one or more examples of the present disclosure.

FIGS. 3 and 4 show the operation of a puck lock 128 in an unlocked configuration 144 and a locked configuration 146, respectively. The puck lock 128 includes a body 148 and a shackle 150. A keyhole 152 provides access for the key 134 to lock/unlock the shackle 150 to/from the body 148 and lock/unlock the assembly. FIG. 3 shows the lock 128 with the shackle 150 unlocked and/or removed from the body 148 by the key 134 rotating in the keyhole 152.

The lock 128 in FIG. 3 is in an unlocked configuration 144 but is in the locked configuration 146 in FIG. 4. The lock 128 is locked by inserting the key 134 into the shackle 150 and rotating relative to the body 148. In the locked configuration of FIG. 4, the shackle 150 inserts within the body 148. In general, the shackle 150 of the lock 128 passes through an opening of a puck lock tab 119 (see, FIG. 2) to lock or restrain, the movement/opening of the box-cover 132. The puck lock shown in FIGS. 3 and 4 is a lock 128 where the shackle 150 inserts and is stored within the body 148. Other lock 128 configurations (e.g., pad-lock, etc.) with a shackle 150 and a body 148 are contemplated.

Figure 5:
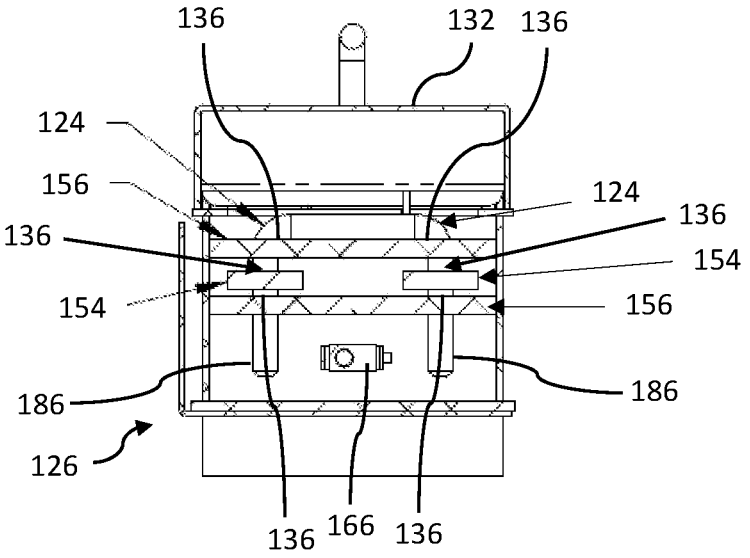
FIG. 5 is an elevated cross-sectional view of an abutment containing a locking pin in an engaged position, according to one or more examples of the present disclosure.
Figure 24:
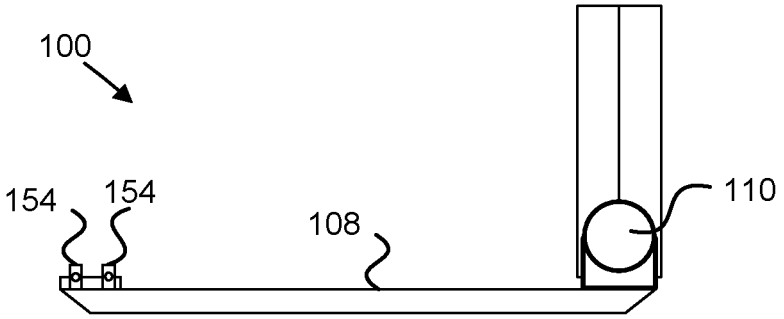
FIG. 24 is a top view of the gate illustrated in FIG. 1, according to one or more examples of the present disclosure.

FIG. 5 shows a cross-section of the abutment 122 with the lockpin 124 in an engaged position 126. In various embodiments, the lockpin 124 includes two, four, or six contact surfaces 136 between a pair of lock tabs 154 and/or a pin plate 156 in the abutment 122. In various examples, the lock tabs 154 are located on the support 138, and the pin plate 156 is located on the box-cover 132, creating two contact surfaces 136 at the lock tabs 154. Conversely, when the lock tabs 154 are located on the box-cover 132 and the support 138 includes the pin plates 156, four contact surfaces 136 are created at the pin plate 156. Similarly, the arm 108 may include either the lock tabs 154 (see, e.g., FIG. 24) or the pin plate 156 and the support 138 includes the other of the lock tabs 154 or the pin plate 156.

When the attachment 116 of the arm 108 includes two or four contact surfaces 136 (e.g., at the pin plates 156 or lock tabs 154) and the support 138 includes the other four or two illustrated contact surfaces 136 (e.g., at the other of the lock tabs 154 or the pin plate 156), the joint may include six contact surfaces 136, which reduces the total shear/bearing inversely proportionally. The ability to design the lockpin 124 within the abutment 122 enables a designer to redistribute loads and/or stresses in the load path. The loads can be more evenly distributed than when the force is distributed entirely onto the shackle 150 of the lock 128. For example, the increased number of contact surfaces 136 may reduce the loads experienced at the abutment 122 by a factor of two, four, six, or more.

The box-cover 132 may be a secondary structure 130 that the lock 128 attaches to the abutment 122. For example, the box-cover 132 may capture the attachment 116 of the arm 108 between the box-cover 132 and the support 138 on the post 114. As illustrated in FIG. 5, each lock tab 154 may be in double shear with the pin plate 156 so that the lockpin 124 creates two or more double shear joints.

Figure 6:
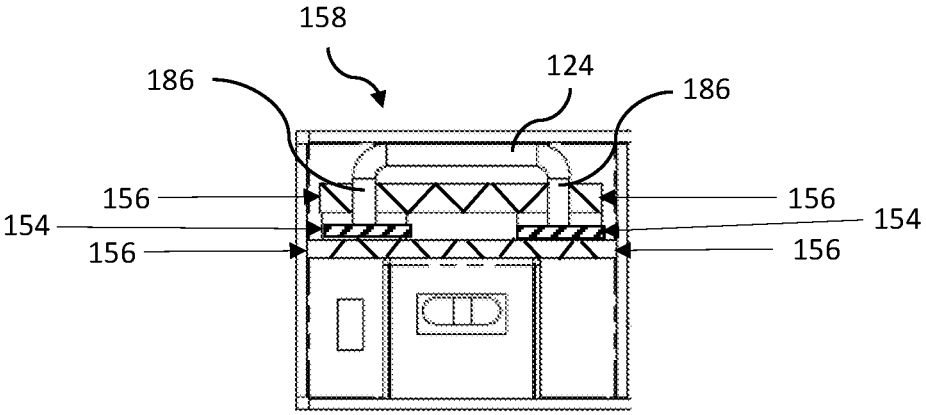
FIG. 6 is an elevated cross-sectional view of the abutment of FIG. 4 with the locking pin in a disengaged position, according to one or more examples of the present disclosure.

FIG. 6 shows the lockpin 124 in a disengaged position 158. The lockpin 124 does not inhibit rotation of the arm 108 about the pivot 110 at the first end 112 and the gate 100 may be opened. A user can insert the key 134 into the keyhole 152 of the lock 128 and remove or release the shackle 150 from engaging the box-cover 132. The box-cover 132 may be a secondary structure 130 outside of the load path (e.g., generated when the locked gate 100 is rotated). The release and/or removal of the secondary structure 130 and/or box-cover 132 provides access to the lockpin 124, but does not change the load path. The movement of the lockpin 124 from the engaged position 126 shown in FIG. 5 to the disengaged position 126 illustrated in FIG. 6 frees the rotational degree of freedom of the arm 108 at the pivot 110 and changes the load path.

Figure 7:
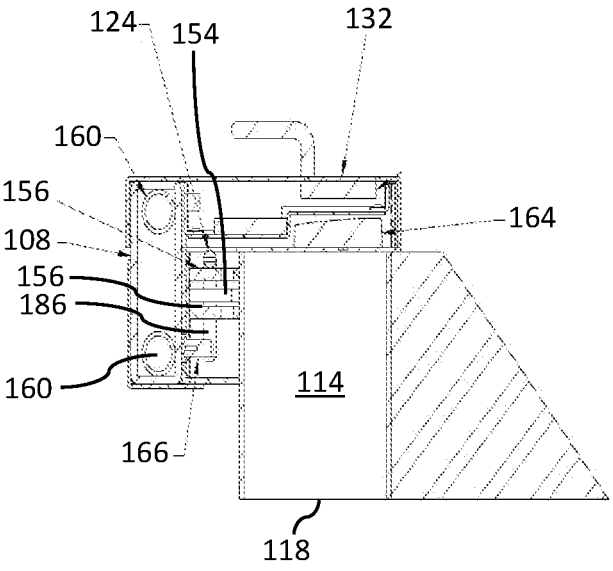
FIG. 7 is an elevated cross-sectional view of the abutment and arm of the gate, according to one or more examples of the present disclosure.

FIG. 7 is a cross-sectional view of the abutment 122 engaging the arm 108 with a lockpin 124 to secure the gate 100. FIGS. 4 and 7 show lockpin 124 in the engaged position 126, but FIG. 7 shows additional structures in the cross-section of the abutment 122 and the arm 108. A rotatable rod 160 may be housed within the arm 108, and various sensors can be housed within the abutment 122. The rotatable rod 146 increases the time needed to cut through the arm 108 by inducing rotation when a saw blade cuts through the arm 108. Various sensors can also be located throughout the gate 100, arm 108, and/or abutment 122 to provide an alarm when certain types of attacks are made on the various components of the gate 100.

Specifically, a heat sensor 162 in thermal communicaiton with the arm 108 sends an alarm signal to activate/trigger an alarm when the arm heated (e.g., from a torch that heats the arm 108 to cut the gate 100). Similarly, a vibration sensor 164 in tactile communicaiton with the arm 108 may send an alarm signal to activate/trigger an alarm when arm 108 is jarred or otherwise moved abruptly. For example, vibration sensor 164 may include a seismic measurement (e.g., seismic sensor) that determines the abrupt movement of arm 108 or other components of the gate 100 and generates and sends the signal. Similarly, a contact switch 166 can send an alarm signal to activate/trigger an alarm when the arm 108 and/or the abutment 122 are not in contact and/or separated by a threshold distance. For example, the contact switch 166 may include a pressure sensor positioned between the attachment 116 of the arm 108 and the abutment 122 that determines the pressure between the attachment 116 of the arm 108 and the abutment 122. The pressure sensor of the contact switch 166 may send an alarm signal to activate/trigger an alarm when the lock 128 has not received the key 134 and/or the measured pressure between two components (e.g., the arm 108, the box-cover 132, the secondary structure 130, and/or the abutment 122) is below a threshold and/or predetermined pressure value.

Figure 8:
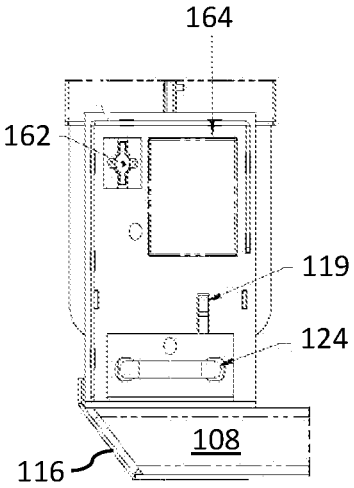
FIG. 8 shows a top view of the abutment with the box-cover removed, according to one or more examples of the present disclosure.

FIG. 8 shows a top view of the abutment 122 with the box-cover 132 removed. In the locked or engaged position 126, the lockpin 124 secures the arm 108, and several sensors are shown distributed within the abutment 122. Other sensor orientations are contemplated and the placement of seismic or sensor 164, heat sensor 162, and/or contact switch 166 within the abutment 122 may include other suitable locations.

Figure 9:
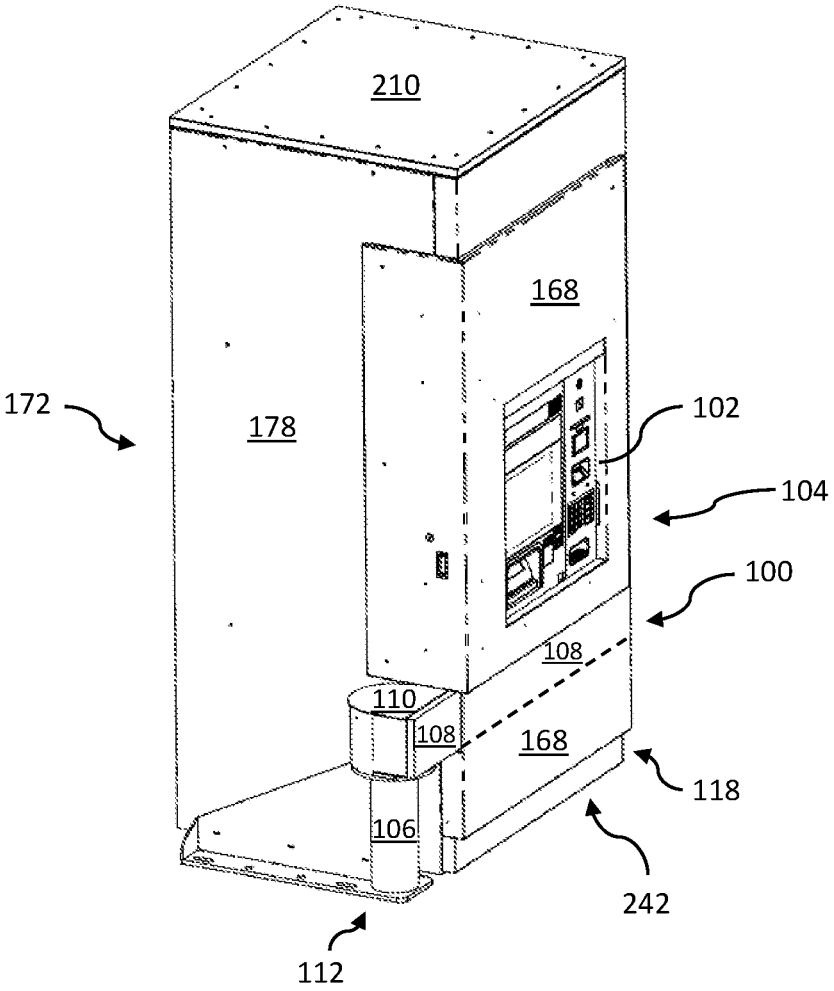
FIG. 9 shows an enclosed ATM within a frame, and the gate is partially visible, according to one or more examples of the present disclosure.
Figure 10:
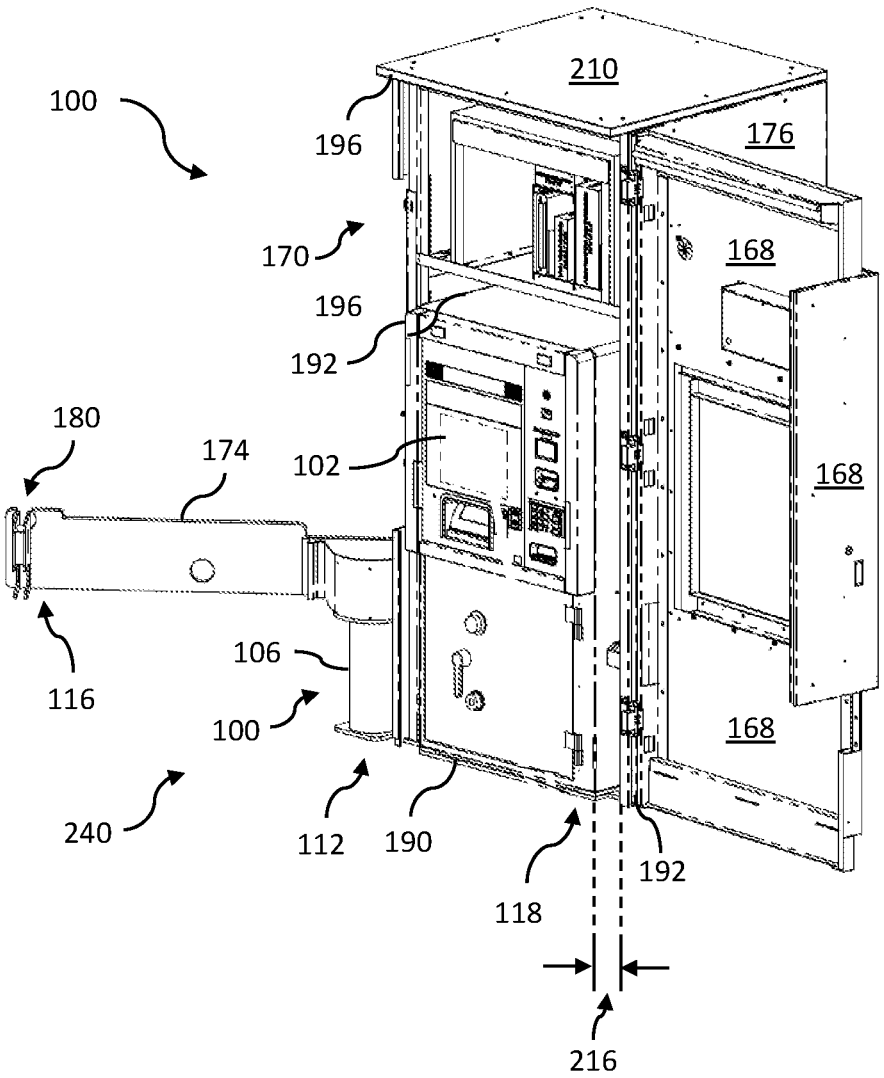
FIG. 10 shows the ATM of FIG. 9 with the gate and the cover in the open/unlocked configuration, according to one or more examples of the present disclosure.

FIGS. 9 and 10 show a partially enclosed ATM 102 in a closed position (see, FIG. 9) and an open/unlocked position (see, FIG. 10). The gate 100 is only partially visible. The cover 168 partially encloses the gate 100 such that only a portion of the gate 100 is visible. For example, only the pivot 110 of the arm 108 is visible and the attachment 116 of the arm 108 and the abutment 122, lock 128, lockpin 124, and/or box-cover 132 are enclosed/surrounded by a cover 168 and are not visible without first opening the cover 168. The cover 168 extends over the user interface 104 and hides the lockpin 124, the lock 128, and other structural components of the mechanical locking devices and/or gate 100.

The cover 168 may completely enclose the abutment 122 and the attachment 116 of the arm 108. In this configuration, the visible portion of the arm 108 includes only the pivot 110 of the arm 108. This may provide a pleasing aesthetic for legitimate customers while notifying potential crooks that the gate 100 is securing the ATM 102. In other words, the cover 168 may hide the abutment 122 at the second end 118 but expose the less vulnerable pivot 110 at the first end 112 to deter would-be criminals and provide a pleasing aesthetic for legitimate customers.

The cover may include a separate security device (e.g., lock 128) or another mechanism for securing and/or opening the cover 168. The gate 100 may further include a frame 170 that surrounds, or partially surrounds, the ATM 102. Specifically, the frame 170 may surround, capture, or enclose the abutment 122, the lock 128, the lockpin 124, and/or other secondary structures 130.

In operation, the authorized user can open the cover 168 protecting the user interface 104 of the ATM 102. The user can provide the key 134 and unlock the shackle 150 of the lock 128 fixed on the secondary structure 130 of the abutment 122 to provide access to the lockpin 124. Removing the lockpin 124 at the second end 118 of the gate 100 frees the arm 108 to rotate. For example, the arm 108 can rotate from the locked position of FIG. 9 to the unlocked position of FIG. 10. The user can then access the ATM 102 and provide any necessary maintenance and/or service to various components (e.g., replacing the money cassettes).

When the gate 100 protecting the ATM 102 is attacked, the rotational forces applied to the arm 108 to open the gate 100 do not generate a force on the lock 128. Specifically, the rotational force exerted on the arm 108 does not shear or bear on any part of the lock 128 (e.g., the body 148 or the shackle 150). More specifically, the body 148 and shackle 150 of the lock 128 secure the secondary structures 130 that provide access to the lockpin 124 that secures the arm 108 of the gate 100. The lockpin 124 includes the contact surfaces 136 to secure the arm 108 of the gate 100 in the engaged position 126. The key 134 unlocks the secondary structure 130 to provide access to the lockpin 124 that secures the arm 108 against the post 114 or frame 170 of the gate 100.

The ATM 102 may be captured within a frame 170 having a 42-inch clearance between the front (e.g., the cover 168 and/or interface 104 shown in the closed position of FIG. 10) and a rear or back panel 172 of the ATM 102. The arm 108 may include rotatable rods 160 housed within the arm 108 (e.g., to prevent a sawing attack (see, e.g., FIG. 7)). The arm 108 can include at least one reinforced steel or structural plate 174 that is at least 0.5 inches thick. For example, the reinforced structural plate 174 is equal to or greater than at least 0.6, 0.7, 0.75, 0.8, 0.9 inches, or 1 inch thick. The reinforced structural plate 174 may provide sufficient structural strength that additional panels and/or rotatable rods 160 may not be used. For example, the reinforced structural plate 174 can abut and secure the ATM 102 with reduced clearance. This configuration may enhance the available area within the frame 170 to be equal to or less than the 42-inch design from the front to back. Since several existing ATMs 102 are designed on a 42-inch platform, the reinforced structural plate 174 may enhance reverse compatibility with previously designed and/or installed ATMs.

Figure 11:
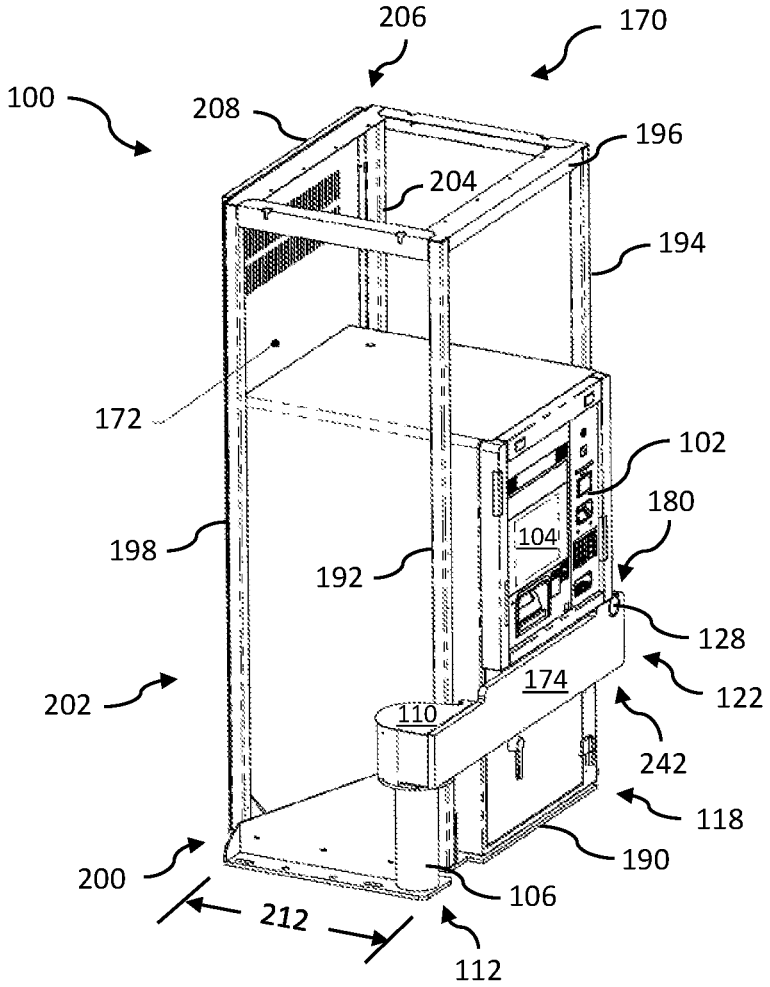
FIG. 11 shows a side perspective view of an ATM with the cover and panels on the frame removed, according to one or more examples of the present disclosure.
Figure 12:
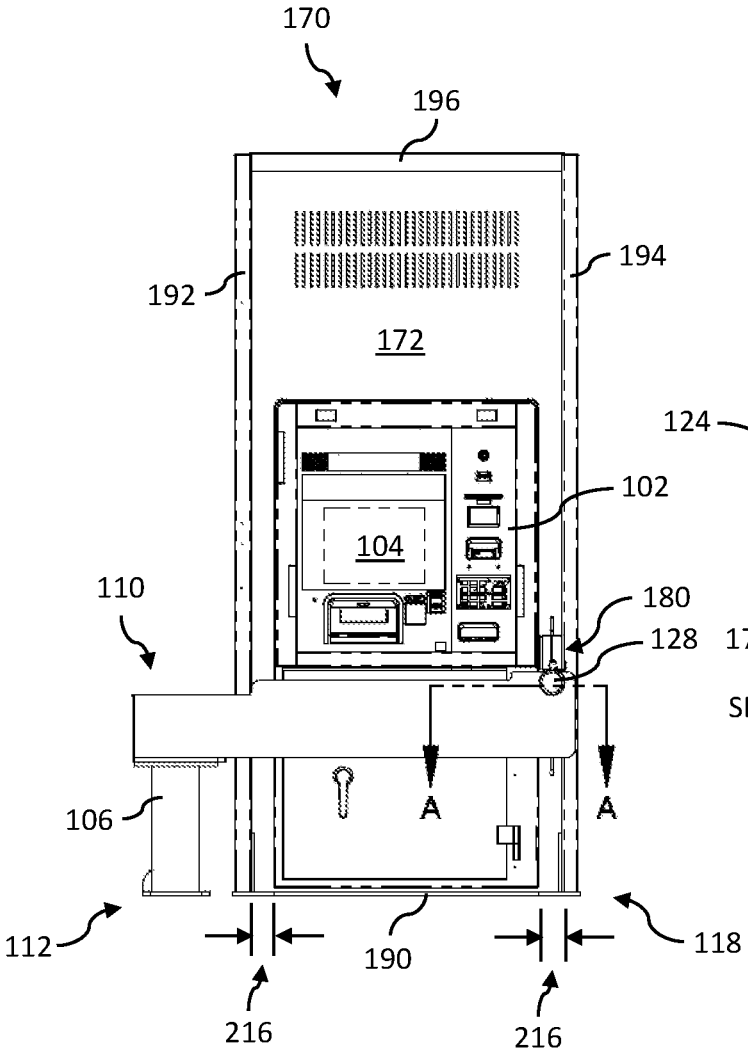
FIG. 12 is a front view of the ATM of FIG. 11 with the cover and side panels removed, according to one or more examples of the present disclosure.
Figure 13:
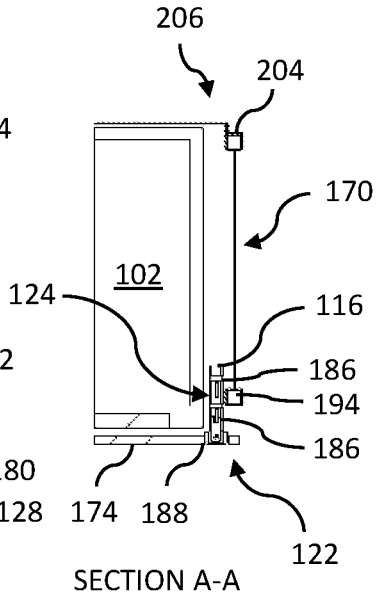
FIG. 13 is an elevated cross-section view of the frame and attachment that form an abutment to receive the lockpin, according to one or more examples of the present disclosure.

FIGS. 11 and 12 show side and front views of an ATM 102 with the cover 168 and a right panel 176 and a left panel 178 on the frame 170 removed. FIG. 13 is an elevated cross-section view of the frame 170 and attachment 116 that form the abutment 122 that receives the lockpin 124 and secures the gate 100. Regarding FIGS. 11-13, lockpin 124 is shown with two contact surfaces 136 bearing against the attachment 116 and secured within the frame 170. The lock 128 is housed within a pocket 180 of the gate 100 and secondary structure 130 such that rotation of the gate 100 would cause the contact surfaces 136 to engage the attachment 116 and bear against the frame 170 before the shackle 150 of the lock 128 engages the lock tab 154 on the lockpin 124. The shackle 150 locks directly to the lockpin 124. Rotation of the gate 100 when the lock 128 is in the locked configuration 146 results in bearing and/or shear forces at the contact surfaces 136 but does not load the shackle 150 of the lock 128. The configuration disguises the purpose of the lock 128 and obstructs the locking mechanism of the lockpin 124.

The lock 128 may couple directly to the lockpin 124 and/or prevent releasing the lockpin 124 from the engaged position 126, without being in the attacking load path. An attacker might contemplate forcing the gate 100 to open to release the lock 128, but when the lockpin 124 is in the engaged position 126 the force rotating the arm 108 is distributed to the frame 170 at the contact surfaces 136. In other words, the shackle 150 and/or body 148 of the lock 128 are not engaged. Similarly, an attack to pick or force the lock 128 open would not affect the lockpin 124. The arm 108 remains securely restrained until the lockpin 124 is removed/released from the engaged position 126. In other words, an attacker that successfully removes the lock 128 may still be unsuccessful in opening the gate 100 if the location of the lockpin 124 is not discovered and/or the lockpin 124 is not disengaged and/or removed.

Figure 14:
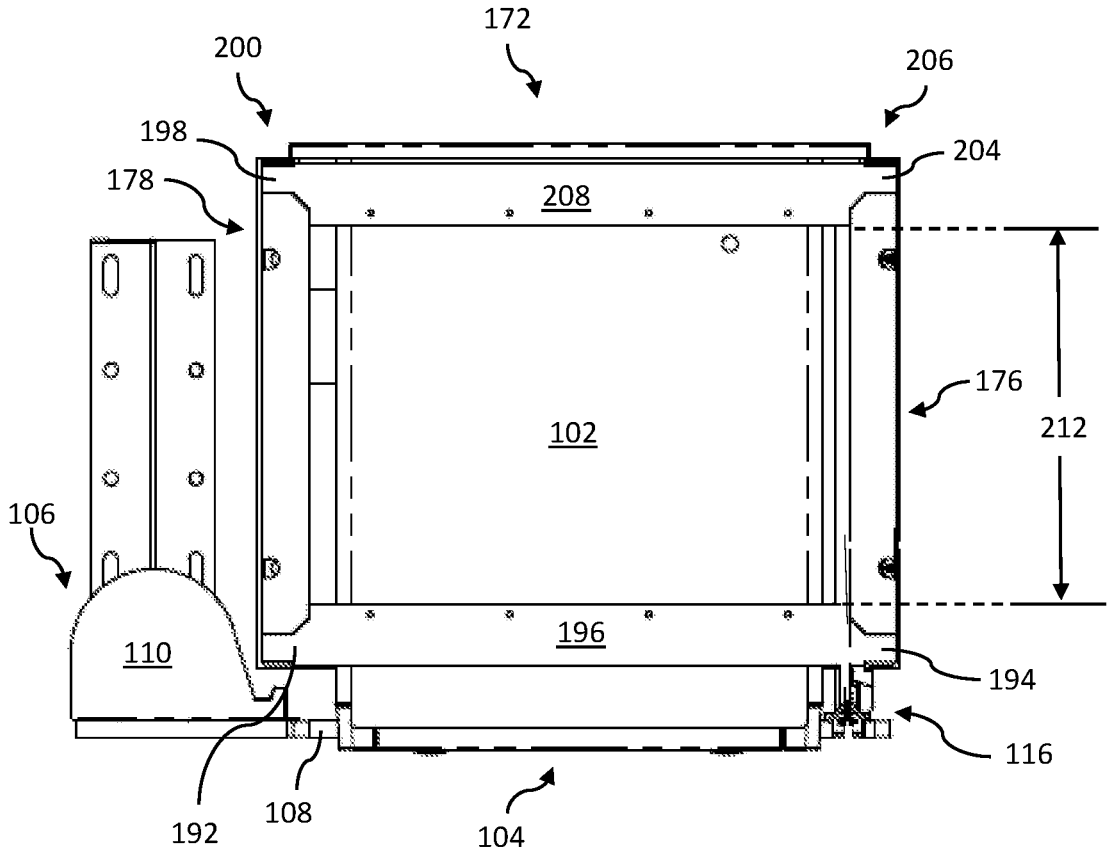
FIG. 14 is a top view of an ATM showing an abutment, according to one or more examples of the present disclosure.
Figure 15:
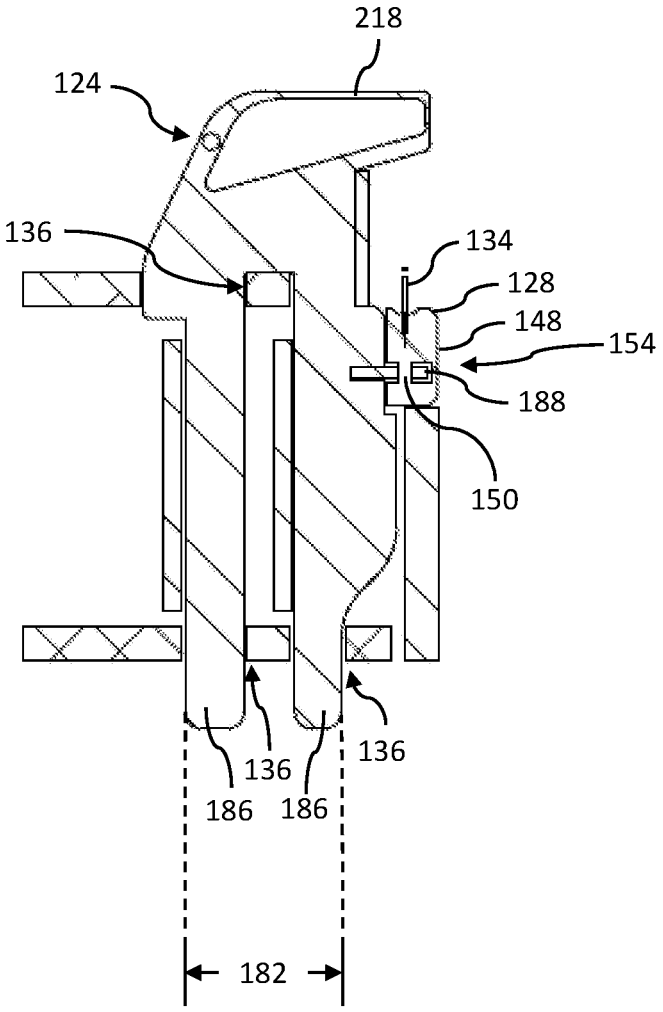
FIG. 15 is an elevated cross-sectional view of the abutment of FIG. 14 illustrating a lockpin in an engaged position between the attachment and the frame, according to one or more examples of the present disclosure.

FIG. 14 is a top view of the frame 170 of the ATM 102 including the cross-section at the abutment 122 illustrated in FIG. 15. FIGS. 14 and 15 show how the lockpin 124 slides through the attachment 116 of the arm 108 and into the frame 170 in an engaged position 126. When lockpin 124 is between the attachment 116 and the frame 170, the contact surfaces of the lockpin 124 bear against the frame 170 to keep the arm 108 secure. The shackle 150 of the lock 128 engages the lock tab 154 on the lockpin 124.

The abutment 122 includes the lockpin 124 and the lock 128. The lockpin 124 engages the attachment 116 on the arm 108. When the lockpin 124 is in the engaged position 126 bearing on contact surfaces 136 of the lockpin 124 prevent the arm 108 from rotating and/or pivoting about the pivot 110. The lockpin 124 removes the rotational degree of freedom of the arm 108.

The lock 128 couples to the lockpin 124 of the abutment 122. The lock 128 prevents access to the lockpin 124 in the abutment 122, for example, without a key 134. An attack may be prevented without knowledge of the location and/or function of the lockpin 124. Applied forces to rotate the arm 108 do not engage the lock 128. When the lockpin 124 is in the engaged position 126 the arm 108 is secure, regardless of whether the lock 128 is in the locked configuration 146 or the unlocked configuration 144.

The lockpin 124 includes a width 182 inserted in the frame 170 that may be equal to or greater than a width 184 of the body 148 of the lock 128 (see, FIGS. 3 and 4). The width 182 of the lockpin 124 extends between at least two protrusions 186 (e.g., that create a double shear joint on the lockpin 124). The width 182 of the lockpin 124 and/or the double shear joint configuration created by the protrusions 186 may reduce the likelihood of failure at the lockpin 124. In other words, the width 182 and/or the protrusions 186 reduce and/or re-distribute the forces on the lockpin 124. When the rotational force at the gate 100 is distributed on the lockpin 124, the resultant force is distributed to the frame 170 in double shear at the contact surfaces 136. This configuration may reduce the vulnerability of an attack at the abutment 122.

The lockpin 124 may include a tongue 188 (e.g., a secondary structure 130 similar to the lock tabs 154) that extends outward from the lockpin 124. The shackle 150 of the lock 128 can directly engage the tongue 188 in the locked configuration 146 to prevent removal of the lockpin 124. In this configuration, the lock 128 secures the lockpin 124 and the lockpin 124 secures the arm 108. When the lockpin 124 is in the engaged position 126, a force that tends to rotate the arm 108 bears against the lockpin 124. The rotational force does not bear against the lock 128 (e.g., either the shackle 150 or the body 148). In other words, the rotational force includes a load path that does not include the lock 128. Any attempt to force open gate 100 stresses the lockpin 124 rather than the lock 128. Similarly, destruction or removal of the lock 128 does not by itself enable rotation of the arm 108 on the gate 100. A force on the lockpin 124 would cause a reaction force on the lock 128 within the pocket 180.

Figure 16:
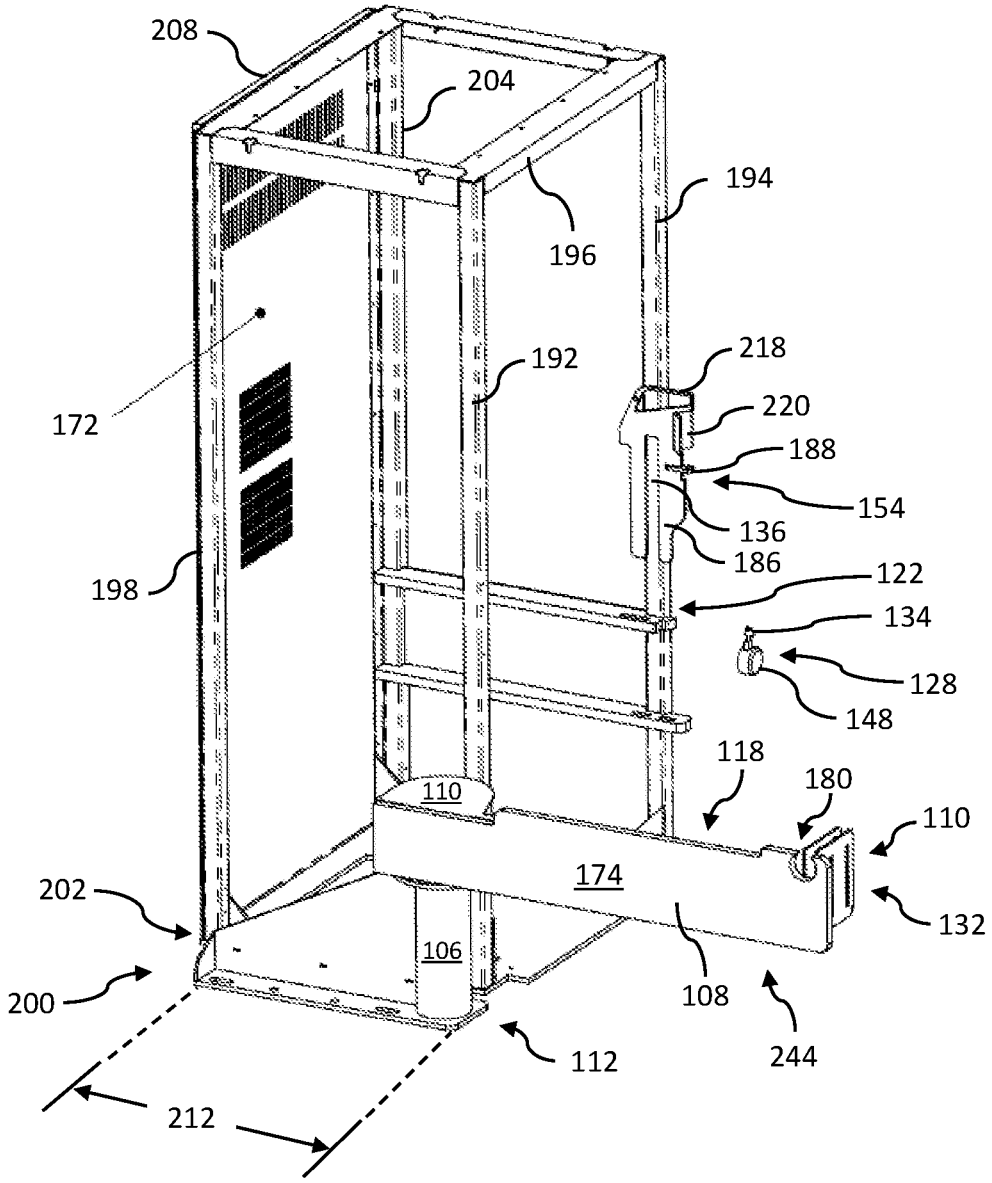
FIG. 16 is a perspective view of the frame, gate, and lockpin with the side panels and ATM removed, according to one or more examples of the present disclosure.

FIG. 16 is a perspective view of the frame 170 within the cover 168. The frame 170, gate 100, and lockpin 124 include the right panel 176 and left panel 178 and ATM 102 of FIGS. 9 and 10 removed. The frame 170 includes a base plate 190, a first stile 192 coupled to the base plate 190 at a first end 114, a second stile 194 coupled to the base plate 190 at a second end 118 opposite the first end 112 and a rail 196 extending over the base plate 190 between the first stile 192 and the second stile 194. The cover 168 extends between the first stile 192 and the second stile 194 and at least partially surrounds the attachment 116 of the arm 108 and/or the abutment 122.

The frame 170, the first stile 192, the second stile 194, and/or the rail 196 may be enclosed (e.g., in a brick wall surrounding the ATM 102). In various embodiments, the frame surrounds the ATM 102 and may further include a third stile 198 at a third rear end 200 and coupled to a rear 202 of the base plate 190 at the third rear end 200 opposite the first stile 192 at the first end 112. An additional fourth stile 204 may be located at a fourth rear end 206. The fourth stile 204 may be coupled to the rear 202 of the base plate 190 at the fourth rear end 206 opposite the second stile 194 at the second end 118 to create a box-like enclosure for the ATM 102. A rear rail 208 extends between the third stile 198 and the fourth stile 204 opposite the rail 196 in the front interface 104 that extends between the first stile 192 and the second stile 194, such that the frame 170 surrounds the ATM 102 or other secured structure.

The frame 170 can support various panels (e.g., back panel 172, right panel 176, and/or left panel 178) that surround ATM 102 and/or partially or completely surround the gate 100 securing the ATM. Regarding FIGS. 9-10 and 16, the frame 170 can support the left panel 178, the right panel 176, and/or the back panel 172. In various embodiments, the panels are secured directly to the frame 170. For example, the panels can be fastened, welded, bonded, formed, or otherwise coupled to the frame 170.

In various embodiments, the left panel 178 is coupled (e.g., welded) to and extends between the first stile 192 and the third stile 198. The right panel 176 is welded to and extends between the second stile 194 and the fourth stile 204. The back panel 172 is welded to and extends between the third stile 198 and the fourth stile 204. In embodiments, the first stile 192, the second stile 194, the third stile 198, and/or the fourth stile 204 are welded directly to the base plate 190. The rail 196 and/or rear rail 208 form a structural frame 170 that surrounds the ATM 102. For example, the rail 196 is welded to the first stile 192 and the second stile 194 and the rear rail 208 is welded to the rear third stile 198 and the rear fourth stile 204.

A cap 210 may extend over the ATM 102 and between the panels and/or frame 170. For example, the cap 210 may be welded to the rail 196 in the front and the rear rail 208. Similarly, the cap 210 may extend between the cover 168, the back panel 172, the left panel 178, and/or the right panel 176. In this way, the cap 210 secures the ATM 102 from above and surrounds the ATM 102 to prevents an attack on the frame 170 and/or other structures.

The installation site often defines the location of the stiles. For example, an installation site with a concrete pad may define the size, location, and/or dimensions of the ATM 102. The location may provide other-dimensional limitations, such as an overhang limiting the height of the ATM and/or side walls or barriers that limit the width of the ATM 102. The depth of the ATM 102 may be limited. For example, a first distance 212 between the first stile 192 and the third stile 198 may be less than or equal to 50, 46, 42, or 38 inches. Similarly, a second distance 214 between the second stile 194 and the fourth stile 204 may be less than or equal to 50, 46, 42, or 38 inches. The first distance 212 and/or second distance 214 define the depth of the ATM and the orientation of the first stile 192 relative to the third stile 198 and second stile 194 relative to the fourth stile 204. In other words, the first distance 212 may be equal to the second distance 214 to define a "thickness" of the ATM 102 in a horizontal direction away from the front interface 104 or cover 168 of the ATM 102.

The stiles may include structural reinforcements. For example, the first stile 192, the second stile 194, the third stile 198, the fourth stile 204, the rail 196, the rear rail 208, the cover 168, and/or the cap 210 may comprise a reinforced steel, titanium, and/or a glass/carbon fiber reinforced plastic material. In one example, the stiles (e.g., 192 and 194) may be welded to the base plate 190, and the rail 196 can be welded to and extends between (e.g., the first stile 192 and the second stile 194). In another example, the stiles (e.g., 192 and 194) include a fiber-reinforced plastic material and are bonded to the base plate 190 and/or the rail 196.

The frame 170 can capture and surround the ATM 102 structure with a clearance 216 that is less than or equal to 1, ¾, ½, or ¼ inches. For example, the frame 170 is located within 0.5 inches or less of the ATM 102 to prevent wrapping a chain around the ATM 102 (e.g., without encircling the reinforced frame 170). In other words, the clearance 216 protects the ATM 102 by restricting the locations of an attack (e.g., chain attack, to the frame 170 and/or gate 100 that are reinforced to withstand the attack).

Figure 17:
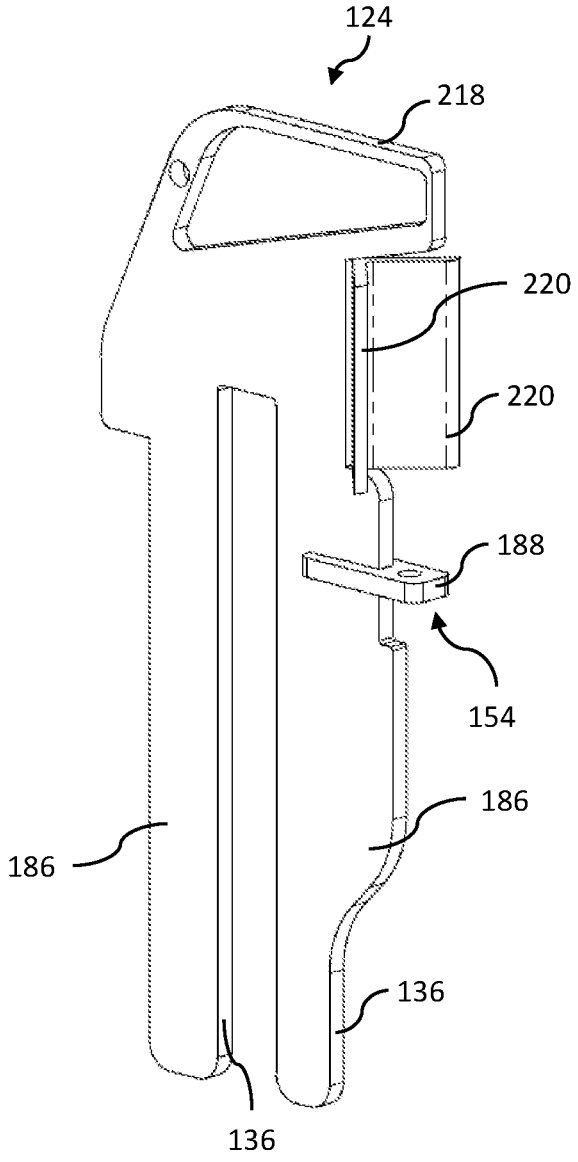
FIG. 17 is a detailed perspective view of the lockpin, according to one or more examples of the present disclosure.

FIG. 17 shows the lockpin 124 having a handle 218, fins 220, and the tongue 188. In the engaged position 126 the fins 220 and the tongue 188 create the pocket 180 in a part of the gate 100 so that the shackle 150 of the lock 128 engages the tongue 188 and the body 148 of the lock 128 engages the fins 220. The fins 220 and pocket 180 secure the lock 128 within the arm 108 and restrain the lockpin 124 within the attachment 116. In other words, in the locked configuration 146, the lock 128 prevents removal of the lockpin 124 but does not inhibit rotation of the gate 100. Similarly, the lock 128 in the locked configuration 146 prevents removal of the lockpin 124 from the frame 170 and/or gate 100. The lockpin 124 prevents rotation of the gate 100 when the lockpin 124 is in the engaged position 126.

The lockpin 124 includes a handle 218 that is designed to prevent a chain attack. For example, a chain wrapped around an exterior of the handle 218 would slide off the tapered edge of the handle 218. Similarly, a chain wrapped through the interior of the handle 218 would fail at the thinnest location of the handle 218 and fail to remove or release the handle 218. The fins 220 are also shaped to capture the lock 128 in a way that wards off a chain attack to either the lock 128 or the lockpin 124. In other words, by redistributing the load path the lockpin 124 redirects the failure points of the attack to areas (e.g., the handle 218 and/or the fins 220) that are most resistant to the attack.

Figure 18:
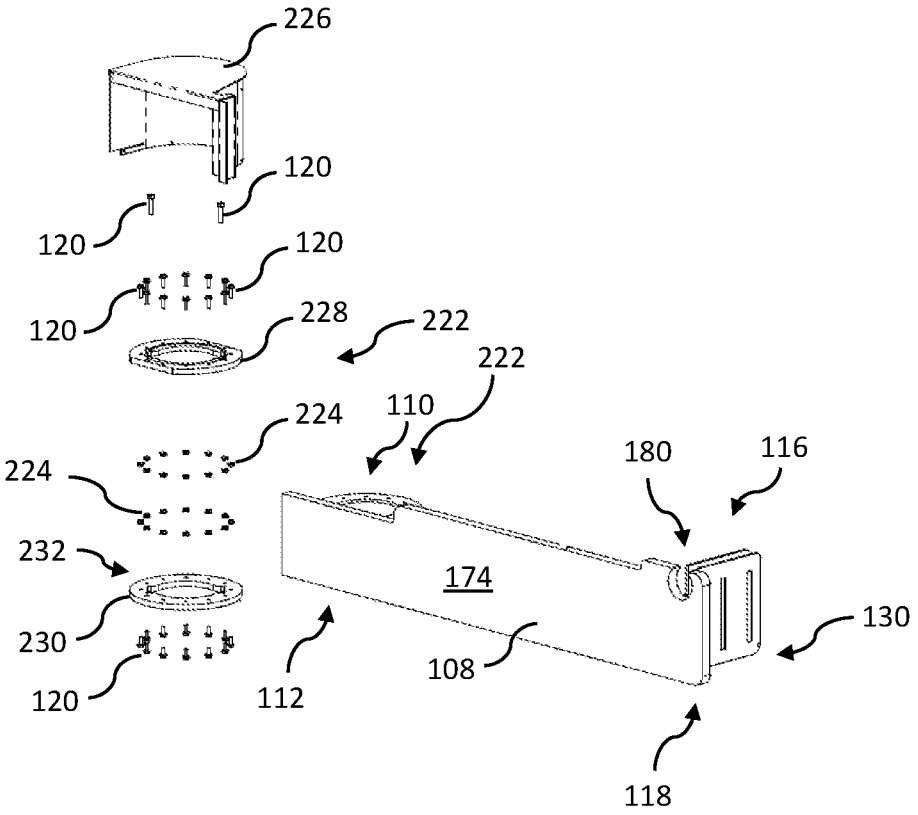
FIG. 18 is an exploded view of a bearing assembly on the pivot of the gate, according to one or more examples of the present disclosure.
Figure 19:
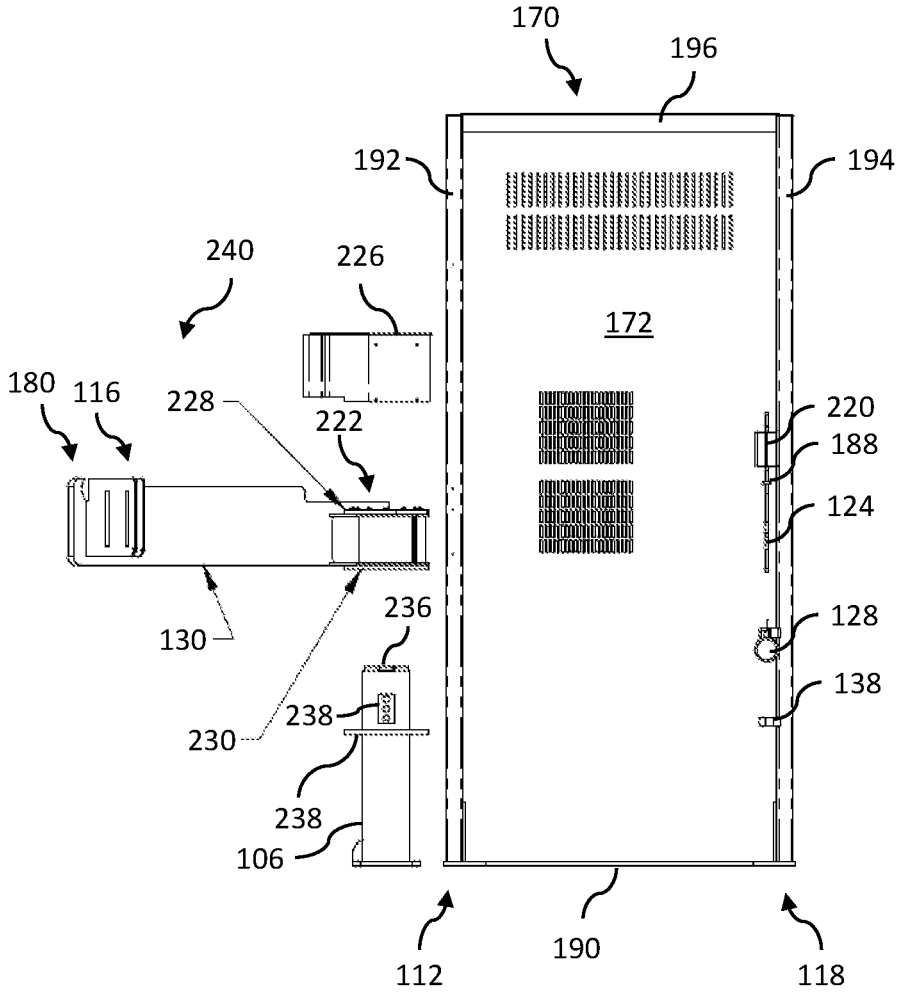
FIG. 19 is an exploded view of the gate, cover, and post for a frame, according to one or more examples of the present disclosure.

FIGS. 18 and 19 are exploded views demonstrating the operation of the gate 100 relative to an alignment joint 222 of a bearing assembly 224 of the pivot 110 on the gate 100. FIG. 19 is an exploded view of the gate 100 with a lid 226 and hinge column 106 for the frame 170. Alignment joint 222 may include an upper bearing 228 and a lower bearing 230 that each include cut-outs 232 (see, FIG. 22) oriented with alignment tabs 234 and a reinforcement 236 on the hinge column 106. A lower support 238 abuts the lower bearing 230 so that as the arm 108 rotates about the pivot 110, the alignment tabs 234 are interposed and captured between the upper bearing 228 and the lower bearing 230. Similarly, the upper bearing 228 is interposed and captured between the reinforcement 236 and the alignment tabs 234. In some embodiments, the lid 226 obscures the operation of the alignment joint 222 within the pivot 110.

Specifically, the support 238 and the alignment tabs 234 support the upper bearing 228 and lower bearing 230 on the pivot 110 of the arm 108 from moving downward axially along the hinge column 106 and the reinforcement 236 and the alignment tabs 234 bear against the upper bearing 228 and lower bearing 230 to restrain axial movement and/or removal of the arm 108. In other words, the alignment joint 222 prevents the removal of arm 108 in any position other than installation position 240.

In general, the alignment joint 222 can provide at least three rotation orientations to the pivot 110 of the arm 108. In the first locked or closed position 242 of FIGS. 9 and 11, the attachment 116 is engaged with the lockpin 124. The lockpin 124 securely locks and restrains the gate 100 and the lock 128 protects access to the lockpin 124. In the second unlocked or open position 244 of FIG. 16, removing the lock 128 and lockpin 124 enables the gate 100 to rotate about the pivot 110 to provide access to the ATM 102 maintenance or repair. However, the arm 108 is still coupled to the hinge column 106 by the support 238. The upper bearing 228 and the lower bearing 230 move the cut-outs 232 relative to alignment tabs 228 and prevent removing the arm 108 until the alignment tabs 234, and cut-outs 232 are properly aligned. In other words, the arm 108 is supported the alignment joint 222 prevents removal of the arm 108.

Figure 20:
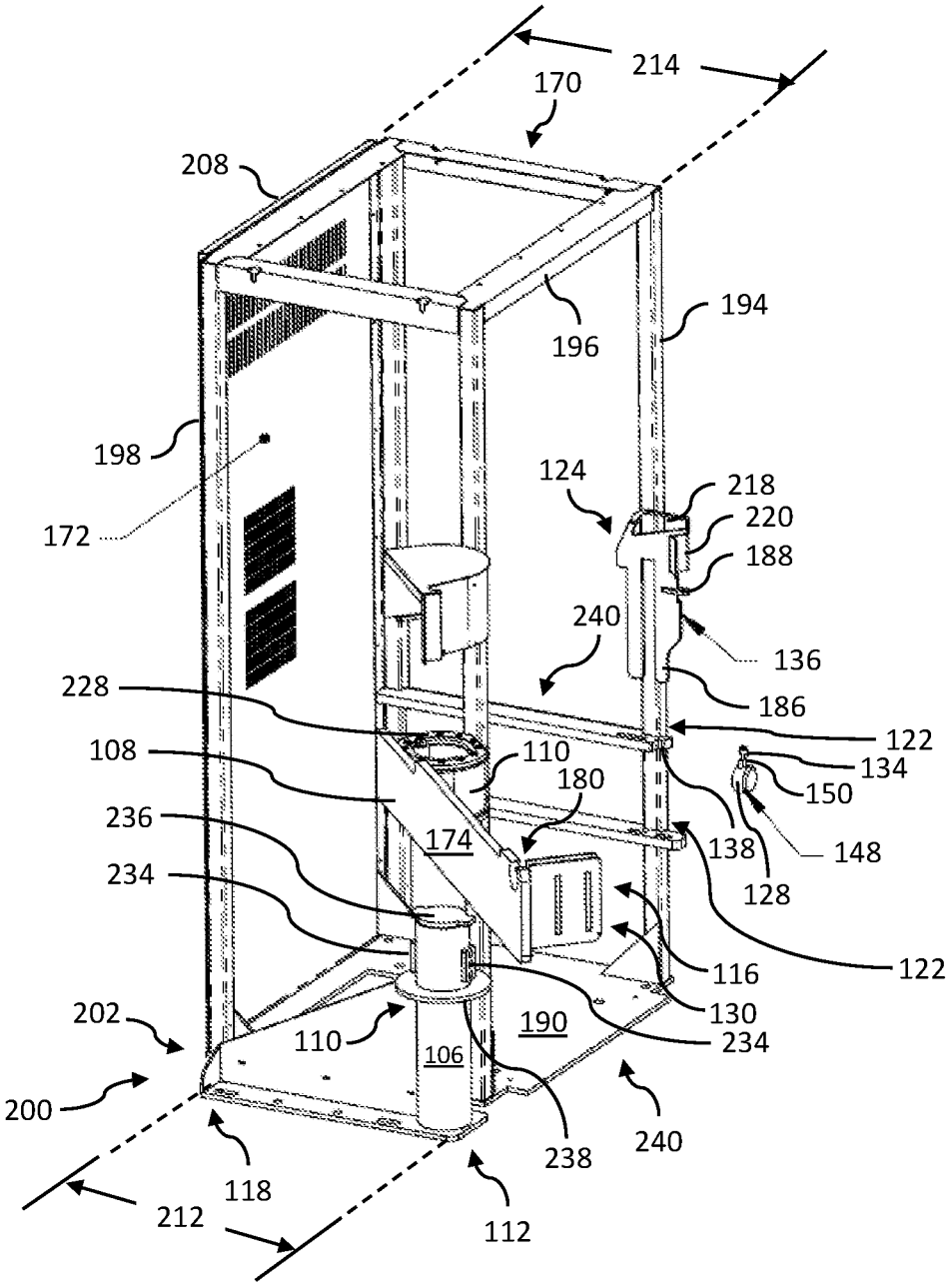
FIG. 20 shows a frame and gate in an installation position for the pivot of the gate, according to one or more examples of the present disclosure.

The cut-outs 232 and alignment tabs 234 create a third orientation or installation position 240 of the alignment joint 222 to install or remove the arm 108, as shown in FIGS. 19 and 20. The cut-outs 232 on the upper bearing 228 and the lower bearing 230 are oriented relative to the alignment tabs 234 to slide the arm 108 over the hinge column 106. The support 238 restrains the lower bearing 230, and the arm 108 is rotated to the open position 244 where the alignment tabs 234 are interposed between the upper bearing 228 and the lower bearing 230. In other words, the installation position 240 may require further rotation from the open position 244 to remove arm 108 and the arm 108 is supported about the pivot 110 as it rotates from the closed position 242 to the installation position 240. In various embodiments, the arm 108 forms an acute or orthogonal angle between a line between the hinge column 106 and the post 114 and the arm 108 in the open position 244. The arm 108 forms an obtuse angle between the line formed by the hinge column 106 to the post 114 and the arm 108 in the installation position 240.

Figure 21:
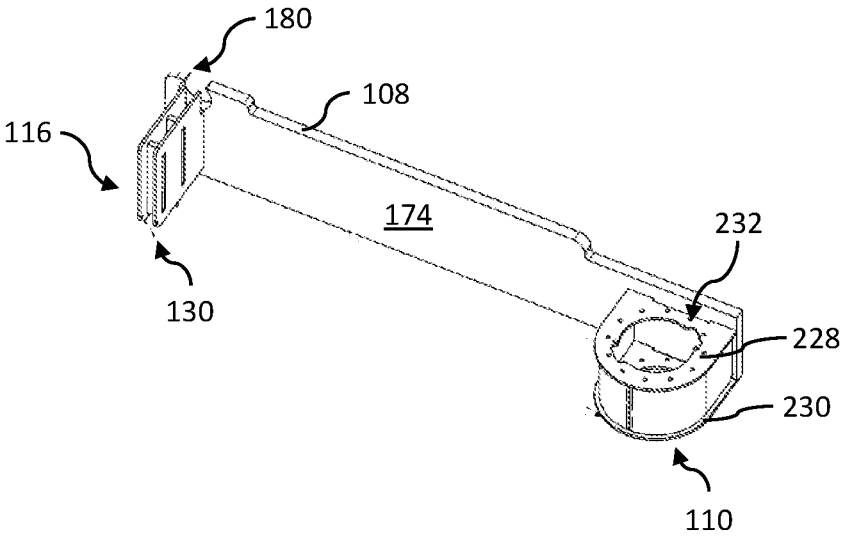
FIG. 21 is an isolated perspective view of the gate, according to one or more examples of the present disclosure.
Figure 22:
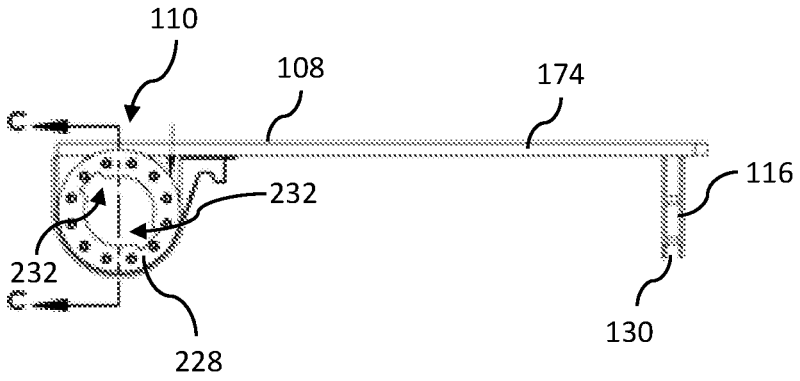
FIG. 22 is a bottom view of the gate showing the pivot and the attachment, according to one or more examples of the present disclosure.

FIGS. 21 and 22 show orientations of the attachment 116 and the pivot 110. The alignment joint 222 includes the cut-outs 232 shown in FIG. 22 to define the angle orientation of the arm 108 in the installation position 240. As shown in FIG. 22, only one position of the cut-out 232 in the pivot 110 of arm 108 enables installment/removal of the arm 108 from the hinge column 106.

Figure 23:
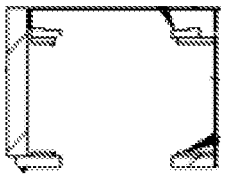
FIG. 23 is an elevated cross-sectional view of the pivot of the gate, according to one or more examples of the present disclosure.

FIG. 23 is an elevated cross-sectional view of the pivot of the gate taken at line C-C of FIG. 22. FIG. 23 shows the orientation of the support 238, the lower bearing 230, the upper bearing 228, and the lid 226.

Reference throughout this specification to "one example," "an example," or similar language means that a particular feature, structure, or 2 characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

In the above description, certain terms may be used such as "up," "down," "upper," "lower," "horizontal," "vertical," "left," "right," "over," "under" and the like. These terms are used, where applicable, to provide some clarity of description when dealing with relative relationships. These terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item, and/or, for example, a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. An apparatus, comprising:

a first support post anchorable to a first position located proximate to a first lateral side of an automatic teller machine (ATM);

a second support post anchorable to a second position located proximate to a second lateral side of the ATM;

an arm extending laterally between the first support post and the second support post, wherein:

the arm is coupled to the first support post, the second support post comprises a plurality of pin plates and a secondary structure housing a lock tab, the arm comprises a plurality of attachment tabs configured to detachably couple the arm to the second support post via the set of pin plates, and the arm is configured to extend laterally across a lateral surface of the ATM when coupled to the first support post and the second support post;

a lockpin comprising a plurality of protrusions configured to engage the plurality of attachment tabs of the arm and the plurality of pin plates of the second support post in an engaged position to couple the arm to the second support post; and a cover comprising an internal lock, the internal lock configured to engage the lock tab in a locked position to fully enclose the lockpin within the cover and the secondary structure to prevent access to the lockpin when in the locked position, wherein:

the first support post and the second support post are separate and independent of each other, and the lockpin is configured to prevent the arm from disengaging from the engaged position with the second support post in response to a force being applied to the arm in the engaged position.

2. The apparatus of claim 1, further comprising:

an abutment configured to provide access to the lockpin to release the lockpin from the engaged position; and a lock configured to lock the abutment.

3. The apparatus of claim 2, wherein, to prevent the arm from disengaging from the engaged position, the lockpin is configured to prevent distribution of the force to the lock.

4. The apparatus of claim 3, wherein the arm further comprises a rotatable rod housed within the arm and extending axially through the arm.

5. The apparatus of claim 2, wherein:

the arm and the abutment are configured to contact each other in a contact position; and the apparatus further comprises a contact switch in communication with the contact position, the contact switch configured to trigger an alarm in response to the arm and the abutment failing to be in contact with each other in the contact position.

6. The apparatus of claim 5, wherein:

the abutment comprises a receiver; and the contact switch is configured to:

determine a pressure between the attachment of the arm and the receiver of the abutment, and trigger the alarm in response to the lock failing to at least one of receive a key and detect that the pressure is below a threshold pressure.

7. The apparatus of claim 1, further comprising a heat sensor in thermal communication with the arm, the heat sensor configured to activate an alarm in response to detecting that the arm is being heated.

8. The apparatus of claim 1, further comprising a vibration sensor in tactile communication with the arm, the vibration sensor configured to activate an alarm in response to the arm being jarred.

9. The apparatus of claim 1, wherein:

the lockpin comprises multiple points of contact with the plurality of attachment tabs and the plurality of pin plates; and the lockpin bears against the plurality of attachment tabs and the plurality of pin plates at the multiple points of contact to create a double shear joint.

10. An apparatus, comprising:

a first stile comprising a pair of plates and a pair of holes, wherein a first hole of the pair of holes is configured to receive a first attachment tab of a gate arm and a second hole of the pair of holes is configured to receive a second attachment tab of the gate arm;

a lockpin configured to engage the first attachment tab, the second attachment tab, and each of the pair of plates in an engaged position;

a secondary structure comprising a lock tab within the secondary structure;

a cover configured to engage the secondary structure to fully enclose the lockpin within the secondary structure and the cover; and a puck lock coupled to a bottom surface of the cover and configured to engage the lock tab in a locked position, wherein the puck lock is fully enclosed within the secondary structure and the cover to prevent access to the lockpin when the puck lock is in the locked position with the lock tab.

11. The apparatus of claim 10, wherein the lockpin comprises a double-shear lockpin.

12. The apparatus of claim 10, wherein:

when the lockpin is in the engaged position, a force to rotate the gate arm bears on the lockpin and fails to bear against the puck lock.

13. The apparatus of claim 10 further comprising a frame, the frame comprising:

the first stile at a first front end;

a second stile at a second front end opposite the first front end; and a rail extending between the first stile and the second stile.

14. The apparatus of claim 13, wherein the frame further comprises:

a base plate;

a third stile at a third rear end and coupled to a rear of the base plate at the third rear end opposite the first stile at the first end;

a fourth stile at a fourth rear end and coupled to the rear of the base plate at the fourth end opposite the second stile at the second end; and a rear rail extending between the third stile and the fourth stile opposite the rail extending between the first stile and the second stile, such that the frame surrounds a structure.

15. The apparatus of claim 14, wherein the frame further comprises:

a left panel coupled to and extending between the first stile and the third stile;

a right panel coupled to and extending between the second stile and the fourth stile;

a back panel coupled to and extending between the third stile and the fourth stile; and a cap coupled to the rail and the rear rail and extending between the back panel, the left panel, and the right panel;

wherein:

the first stile, the second stile, the third stile, and the fourth stile are coupled to the base plate, the rail is coupled to the first stile and the second stile, and the rear rail is coupled to the rear third stile and the rear fourth stile.

16. The apparatus of claim 14, wherein:

the first stile, the second stile, the third stile, and the fourth stile comprise reinforced steel; and the frame is disposed around the structure with a clearance between the frame and the structure.

17. An Automated Teller Machine (ATM), comprising:

a frame comprising:

a base plate;

a first stile coupled to the base plate at a first end, the first stile comprising a pair of lock plates spaced apart from one another;

a second stile coupled to the base plate at a second end; and a rail extending over the base plate between the first stile and the second stile;

a gate comprising:

an arm comprising a pair of attachments configured to be positioned between the pair of lock plates; and an abutment comprising:

a lockpin configured to engage the attachment and each of the pair of lock plates in an engaged position to prevent the arm from unlocking;

a secondary structure comprising a lock tab within the secondary structure;

a cover configured to engage the secondary structure to fully enclose the lockpin within the secondary structure and the cover; and a lock coupled to a bottom surface of the cover and configured to engage the lock tab in a locked position, wherein the lock is fully enclosed within the secondary structure and the cover to prevent access to the lockpin when the lock is in the locked position with the lock tab.

18. The ATM of claim 17, wherein:

the base plate, the first stile, the second stile, and the rail comprise reinforced steel;

the first stile and the second stile are coupled to the base plate; and the lock rail is coupled to and extends between the first stile and the second stile.

19. The ATM of claim 17, wherein:

the frame is located within a predetermined distance of the ATM; and the frame prevents wrapping a chain around the ATM without encircling the frame.

20. The Atm of claim 17, wherein:

the pair of attachments comprise a pair of attachment tabs; and the lock comprises a puck lock.

* * * * *